US009256193B2

(12) United States Patent
Aoi et al.

(10) Patent No.: US 9,256,193 B2
(45) Date of Patent: Feb. 9, 2016

(54) IMAGE FORMING APPARATUS HAVING COVER MEMBER WITH LOCKING MEMBER

(71) Applicant: Brother Kogyo Kabushiki Kaisha, Nagoya-shi, Aichi-ken (JP)

(72) Inventors: Yosuke Aoi, Nagoya (JP); Takuya Yamaguchi, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/667,239

(22) Filed: Mar. 24, 2015

(65) Prior Publication Data

US 2015/0346677 A1 Dec. 3, 2015

(30) Foreign Application Priority Data

May 30, 2014 (JP) ..... 2014-112145

(51) Int. Cl.
*G03G 15/00* (2006.01)
*G03G 21/16* (2006.01)

(52) U.S. Cl.
CPC ..... *G03G 21/1633* (2013.01)

(58) Field of Classification Search
CPC ..... G03G 21/1633
USPC ..... 399/107
See application file for complete search history.

(56) References Cited

U.S. PATENT DOCUMENTS

| | | | | |
|---|---|---|---|---|
| 5,802,426 | A * | 9/1998 | Miyazaki | G03G 21/1633 399/113 |
| 7,708,263 | B2 | 5/2010 | Yano et al. | |
| 9,037,073 | B2 * | 5/2015 | Aoyama | G03G 21/1633 399/392 |
| 2006/0267269 | A1 | 11/2006 | Yano et al. | |
| 2014/0112682 | A1 * | 4/2014 | Shimonaga | G03G 21/1633 399/107 |
| 2014/0186083 | A1 * | 7/2014 | Lee | G03G 21/1633 399/392 |

FOREIGN PATENT DOCUMENTS

| | | | |
|---|---|---|---|
| JP | H11-84983 | A | 3/1999 |
| JP | 2005-242168 | A | 9/2005 |
| JP | 2006-315797 | A | 11/2006 |

* cited by examiner

*Primary Examiner* — Susan Lee
(74) *Attorney, Agent, or Firm* — Banner & Witcoff, Ltd.

(57) ABSTRACT

An image forming apparatus includes an image forming unit, a casing, a cover member having an opening and supported by the casing, a first lock member configured to move between a first lock position in which the cover member is locked in an closed position and a first release position in which a locked state of the cover member is released, a tray configured to pivot between a first position covering the opening and a second position uncovering the opening, and a second lock member configured to move between a second lock position in which the tray is locked in the first position and a second release position in which a locked state of the tray is released, the second lock member being configured to move to the second lock position in response to movement of the first lock member to the first release position.

14 Claims, 12 Drawing Sheets

IMAGE FORMING APPARATUS HAVING COVER MEMBER WITH LOCKING MEMBER

CROSS REFERENCE TO RELATED APPLICATION

This application claims priority from Japanese Patent Application No. 2014-112145, filed on May 30, 2014, which is incorporated herein by reference in its entirety.

TECHNICAL FIELD

Aspects of the disclosure relate to an image forming apparatus.

BACKGROUND

A known image forming apparatus, e.g., a printer, includes a sheet supply tray configured to hold a stack of sheets, and a multipurpose tray disposed on a side of the casing and configured to hold a sheet at an open position relative to the casing. Hereinafter, the multipurpose tray is referred to as MP tray.

The image forming apparatus includes a cover member covering the side of the casing and configured to open and close relative to the casing. The cover member has an opening for supplying a sheet to an image forming unit. The MP tray is supported by the cover member such that the MP tray moves between a closed position covering the opening of the cover member and an open position uncovering the opening. The MP tray includes a deformable engagement portion engageable with the cover member. The MP tray is kept in the closed position when the engagement portion of the MP tray engages the cover member.

SUMMARY

In the above image forming apparatus, however, when the cover member is opened quickly, it sometimes happens that the engagement portion of the MP tray is disengaged from the cover member and the MP tray is accidentally open.

Whenever the MP tray is accidentally open except when the user wants to open the MP tray, the user has to close the MP tray, which deteriorates the usability.

Illustrative aspects of the disclosure provide an image forming apparatus designed to improve ease of operation.

According to an aspect of the disclosure, an image forming apparatus includes an image forming unit configured to form an image on a sheet, a casing accommodating the image forming unit therein, a cover member having an opening and supported by the casing such that the cover member pivots between a closed position in which the cover member is closed relative to the casing and an open position in which the cover member is opened relative to the casing, a first lock member configured to move between a first lock position in which the cover member is locked in the closed position and a first release position in which a locked state of the cover member is released, a tray configured to pivot between a first position covering the opening of the cover member and a second position uncovering the opening of the cover member, and a second lock member configured to move between a second lock position in which the tray is locked in the first position and a second release position in which a locked state of the tray is released. The second lock member being configured to move to the second lock position in response to movement of the first lock member to the first release position.

With this structure, the cover member can be opened while the tray is locked in the first position. As the tray is prevented from being opened during opening of the cover member, ease of operation can be improved.

BRIEF DESCRIPTION OF THE DRAWINGS

Reference is made to the following description taken in connection with the accompanying drawings, like reference numerals being used for like corresponding parts in the various drawings.

DETAILED DESCRIPTION

An embodiment of the disclosure will be described with reference to the following drawings. The following description will be first made to a general structure of an image forming apparatus 1 according to the embodiment of the disclosure.

In the following description, the expressions "front", "rear", "upper or top", "lower or bottom", "right", and "left" are used to define the various parts when the image forming apparatus 1 is disposed in an orientation in which it is intended to be used.

Figure 1:
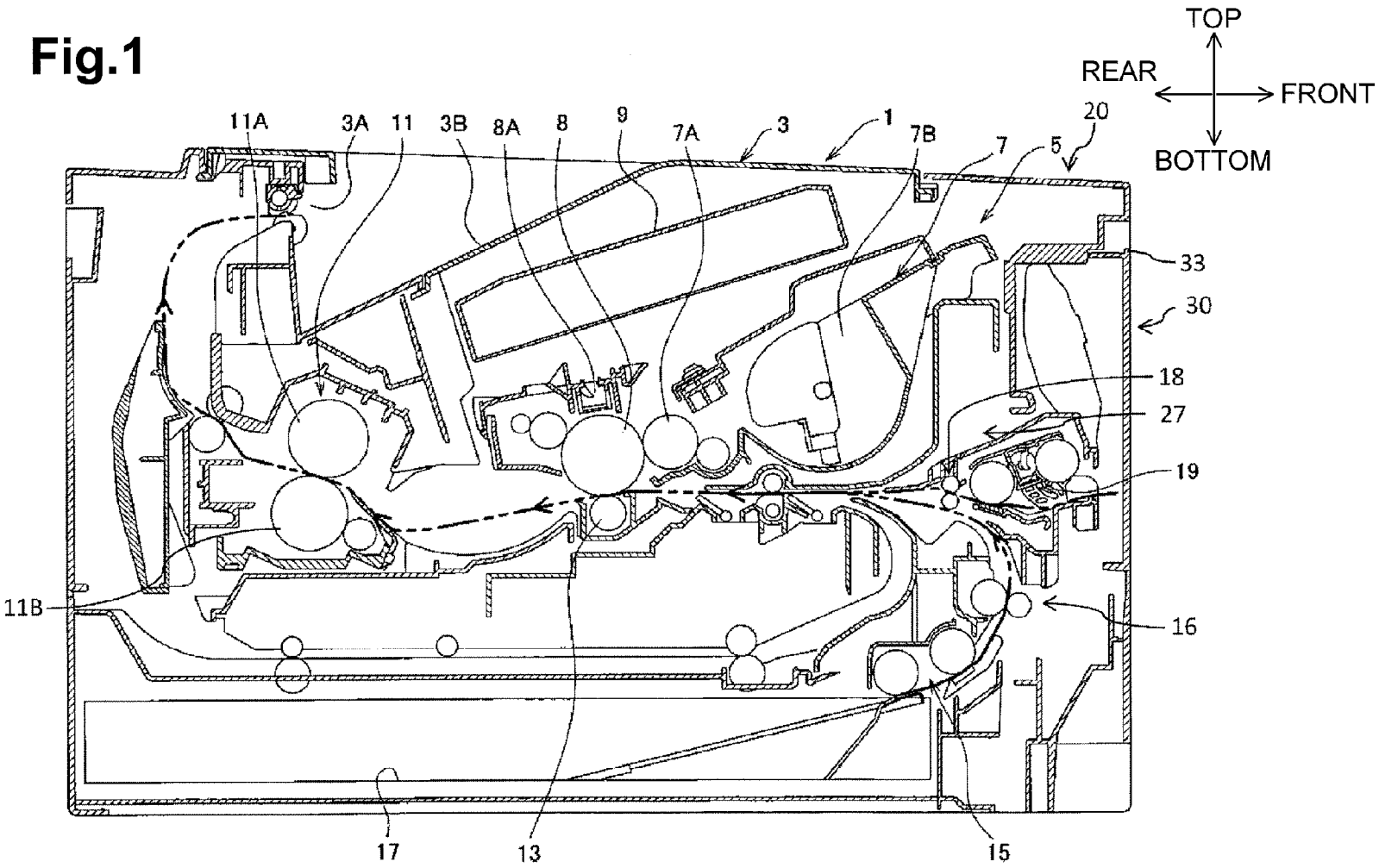
FIG. 1 is a sectional view of an image forming apparatus according to an illustrative embodiment.

As illustrated in FIG. 1, the image forming apparatus 1 include a casing 3, which is substantially box-shaped, a sheet supply tray 17 configured to hold a stack of recording medium, e.g., sheets of plain paper and transparencies, and an image forming unit 5 configured to form an image on a sheet supplied from the sheet supply tray 17. The casing 3 accommodates the sheet supply tray 17 and the image forming unit 5.

An upper surface of the casing 3 contains a printed matter holding portion 3B configured to hold an ejected sheet. A front surface of the casing 3 contains a front cover 20, as an example of a cover member, which is openable and closable relative to the casing 3. The front cover 20 has a substantially rectangular opening 27 for insertion of sheets.

A front portion of the front cover 20 is provided with a multipurpose (MP) tray 30 covering a front surface of the front cover 20 and the opening 27. The MP tray 30 is openable and closable relative to the casing 3.

The image forming unit 5 is configured to form an image on a sheet by transferring a toner image on the sheet. The image forming unit 5 includes a process cartridge 7, a light exposure unit 9, and a fixing unit 11.

The process cartridge 7 includes a toner storing portion 7B storing toner therein, a photosensitive drum 8 configured to carry a toner image thereon, a charger 8A configured to charge the photosensitive drum 8, a developing roller 7A configured to supply toner to the photosensitive drum 8 such that a toner image is carried on the photosensitive drum 8, and a transfer roller 13 configured to transfer the toner image carried on the photosensitive drum 8 onto a sheet.

The fixing unit 11 includes a heat roller 11A configured to be heated by a heat source (not illustrated) and a pressure roller 11B disposed facing the heat roller 11A and pressing the heat roller 11A.

The sheet supply tray 17 is detachably attached to the casing 3. Sheets held in the sheet supply tray 17 are supplied one by one toward the image forming unit 5 by a first sheet supply portion 15 disposed downstream of the sheet supply tray 17 in a sheet feed direction in which sheets are fed. A sheet supplied by the first sheet supply portion 15 is fed to the image forming unit 5 by a first feeding portion 16 disposed downstream of the first sheet supply portion 15 in the sheet feed direction.

The MP tray 30 as an example of a tray is configured to hold a stack of sheets with the front surface of the front cover 20 and the opening 27 being uncovered. Sheets held on the MP tray 30 are supplied one by one toward the image forming unit 5 by a second sheet supply portion 19 disposed downstream of the MP tray 30 in the sheet feed direction. A sheet supplied by the second sheet supply portion 19 is fed to the image forming unit 5 by a second sheet feeding portion 18 disposed downstream of the second sheet supply portion 19 in the sheet feed direction.

When the sheet held in the sheet supply tray 17 or on the MP tray 30 is fed to the image forming unit 5, an image based on image data is transferred onto the sheet.

In the image forming unit 5, a surface of the photosensitive drum 8 rotating is uniformly charged by the charger 8A, and then exposed to a laser beam emitted from the light exposure unit 9 and scanning at high speed. An electrostatic latent image based on the image data is formed on the surface of the photosensitive drum 8 where the potential has become low due to exposure to the laser beam.

Toner stored in the toner storing portion 7B is supplied to the electrostatic latent image formed on the surface of the photosensitive drum 8 by the developing roller 7A and a toner image is formed on the surface of the photosensitive drum 8. When a sheet passes through between the photosensitive drum 8 and the transfer roller 13, the transfer roller 13 transfers the toner image onto the sheet.

The sheet on which the toner image has been transferred is fed to the fixing unit 11, where the toner image transferred onto the sheet is thermally fixed onto the sheet while the sheet passes through between the heat roller 11A and the pressure roller 11B. The sheet on which the toner image has been fixed is ejected onto the printed matter holding portion 3B by an ejection roller pair 3A. It is noted that the image forming unit 5 is of an electrophotographic in the embodiment, however it may be of an inkjet type.

Figure 2:
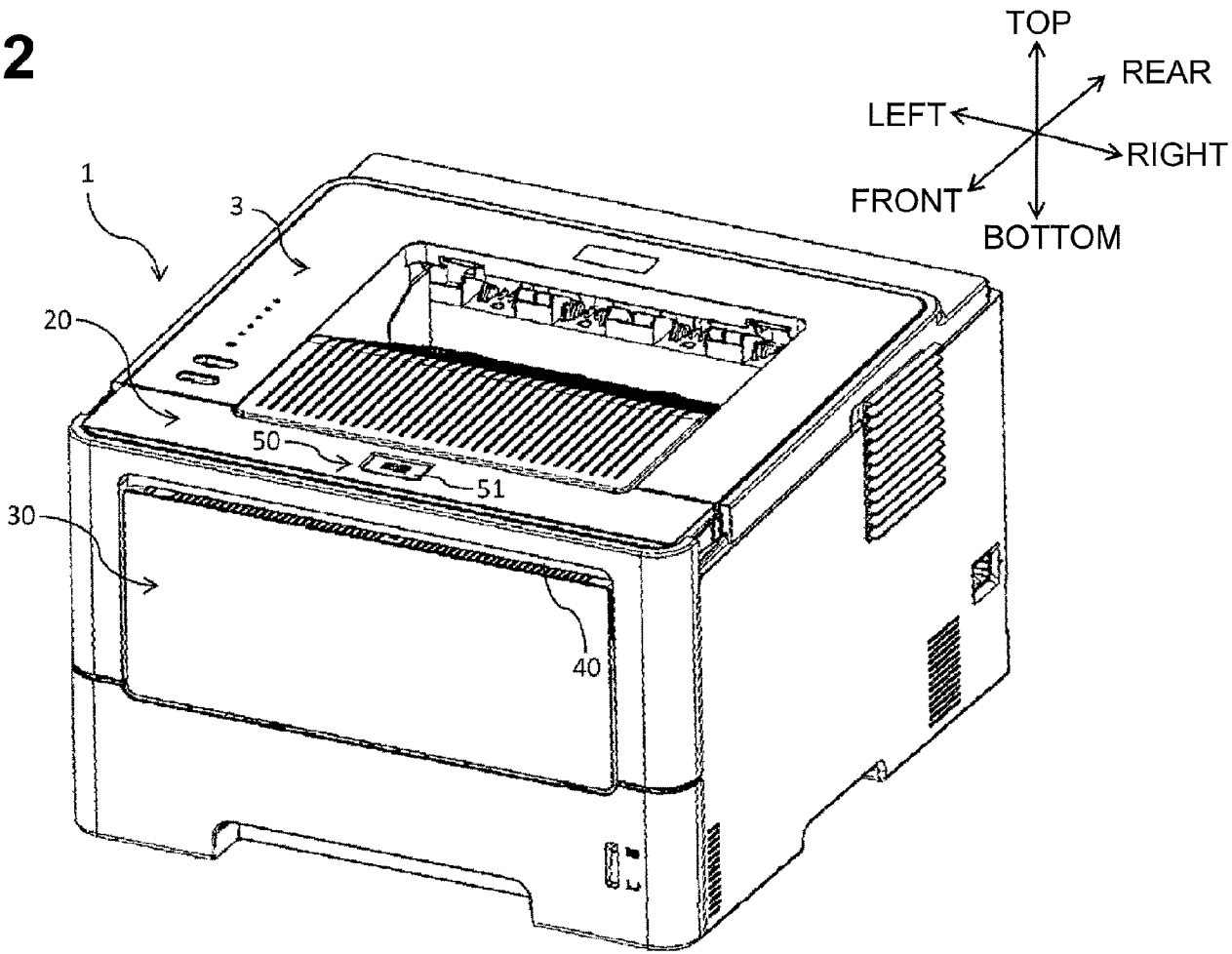
FIG. 2 is a perspective view of the image forming apparatus with a front cover and a MP tray in closed positions.
Figure 3:
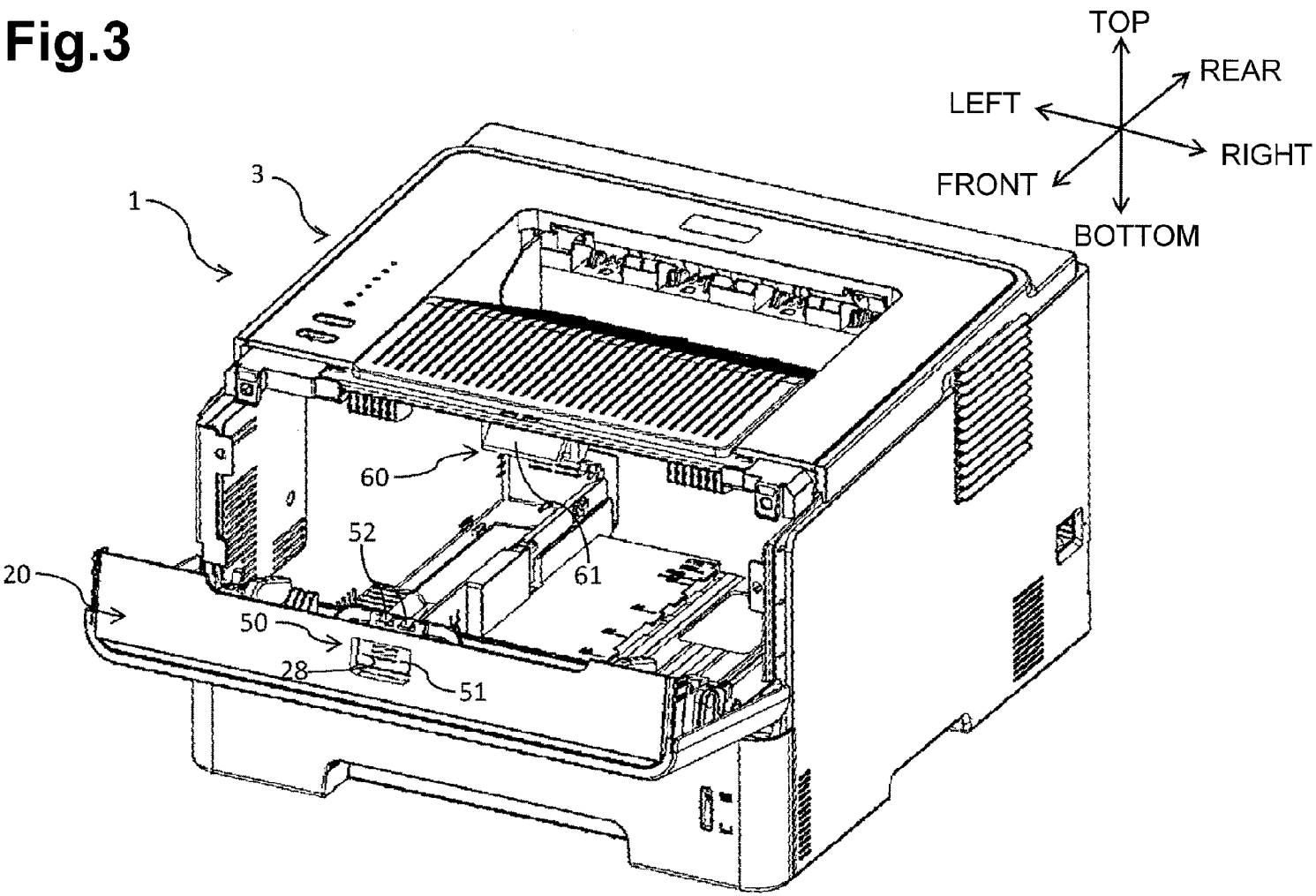
FIG. 3 is a perspective view of the image forming apparatus with the front cover in the open position.

The front cover 20 is supported by the casing 3 such that it pivots about a cover shaft (not illustrated) between a closed position illustrated in FIG. 2 and an open position illustrated in FIG. 3 relative to the casing 3.

Figure 4:
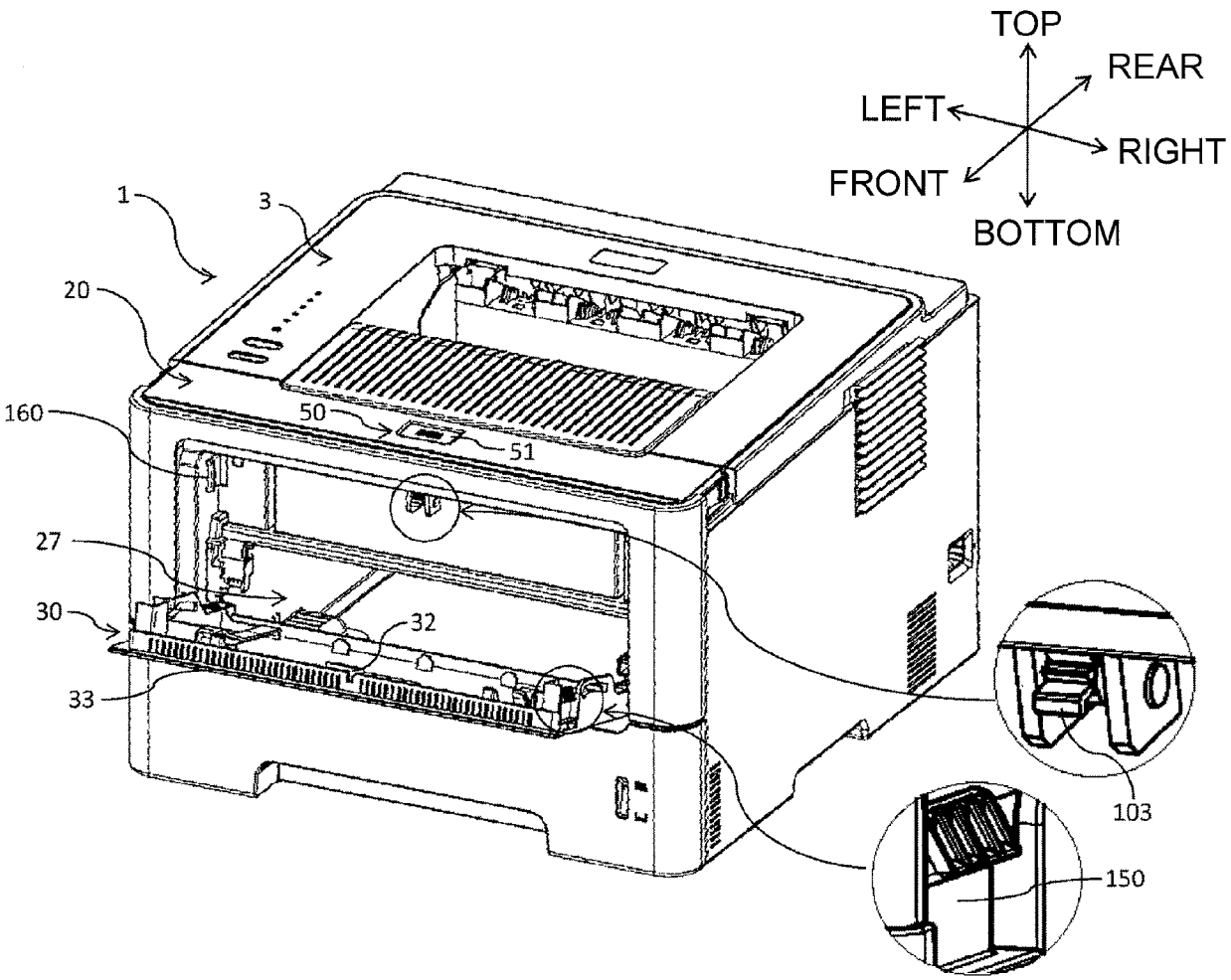
FIG. 4 is a perspective view of the image forming apparatus with the MP tray in the open position.

As illustrated in FIG. 4, the front cover 20 includes left and right tray engaged portions 160. The tray engaged portions 160 are configured to engage with tray engaging portions 150 of the MP tray 160.

Figure 5:
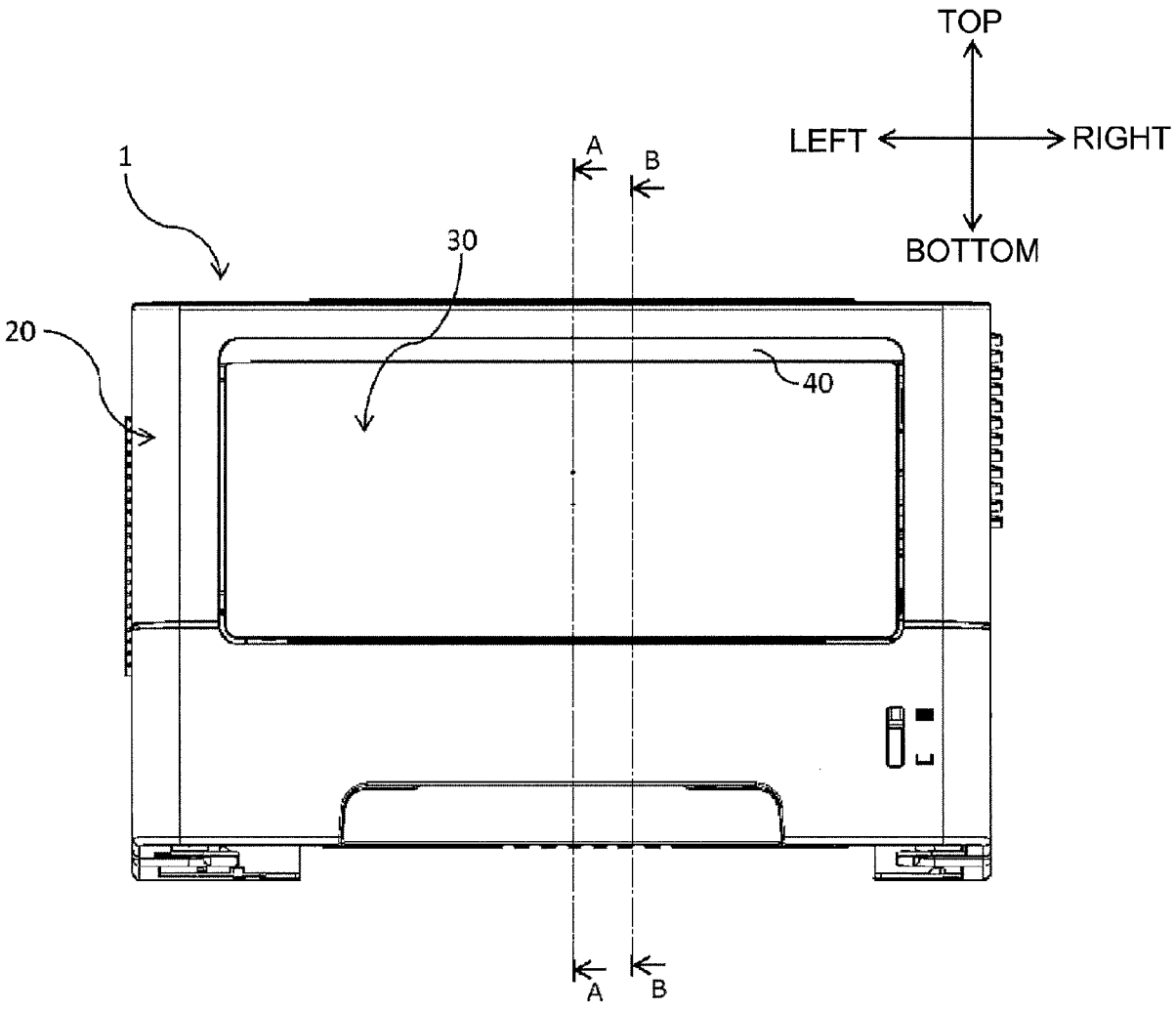
FIG. 5 is a front view of the image forming apparatus with the front cover and the MP tray in the closed position.

As illustrated in FIG. 5, the front cover 20 has a recessed portion 40 which is disposed in an upper portion of the front surface of the front cover 20 and recessed to the rear. The user can place his or her fingertips in the recessed portion 40 to open the MP tray 30.

As illustrated in FIG. 3, an upper surface of the front cover 20 has a through hole 28 in a central portion in the left-right direction. The through hole 28 is substantially rectangular shaped and is formed through the upper surface of the front cover 20.

A first lock member 50 is disposed in the through hole 28. The first lock member 50 is configured to lock the front cover 20 in the closed position or release the lock of the first cover 20.

Figure 6:
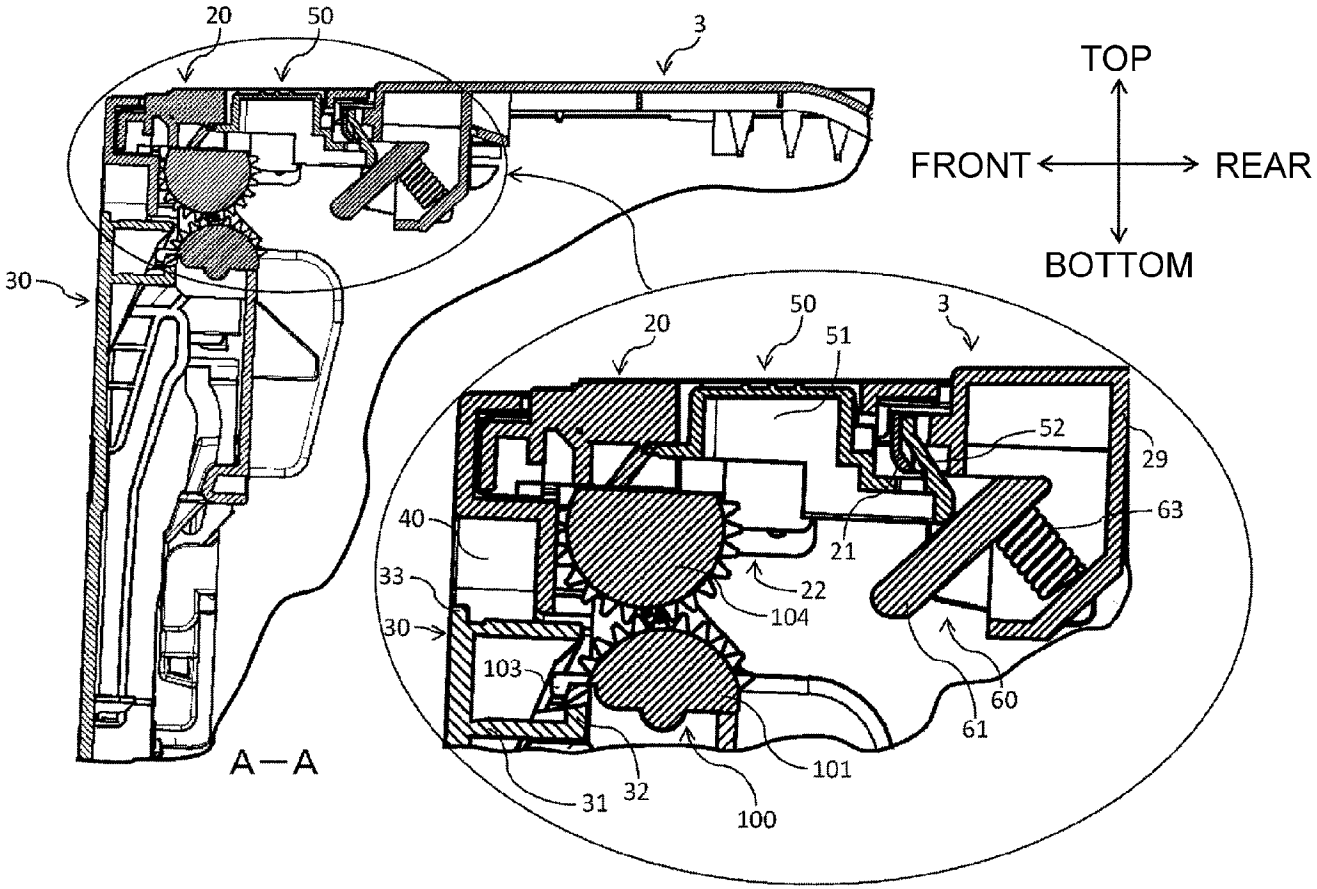
FIG. 6 is a sectional view along the A-A line of FIG. 5 when a pressing portion is in a first lock position.

As illustrated in FIG. 6, the first lock member 50 has a pressed portion 51 and a first engaging portion 52. FIG. 6 is a sectional view of essential parts of the image forming apparatus 1, taken along the A-A line of FIG. 5. A planar cross section taken along the A-A line of FIG. 5 includes a position of a first engaging portion 52.

A pivot (not illustrated) of the first lock member 50 is supported in the front cover 20. The first lock member 50 is configured to pivot about the pivot relative to the front cover 20.

The pressed portion 51 is substantially rectangular shaped when viewed from the top and is disposed in the through hole 28. The pressed portion 51 is exposed to the exterior of the front cover 20 via the through hole 28 and pressed by the user from above.

The first engaging portion 52 is disposed at a rear end portion of the first lock member 50. As illustrated in FIGS. 3 and 6, there are two first engaging portions 52 disposed adjacently in the left-right direction such that they extend upward from the rear end portion of the first lock member 50. The first engaging portions 52 are shaped to engage an engagement receiving portion 21 extending downward from a front upper end portion of the casing 3.

Figure 8:
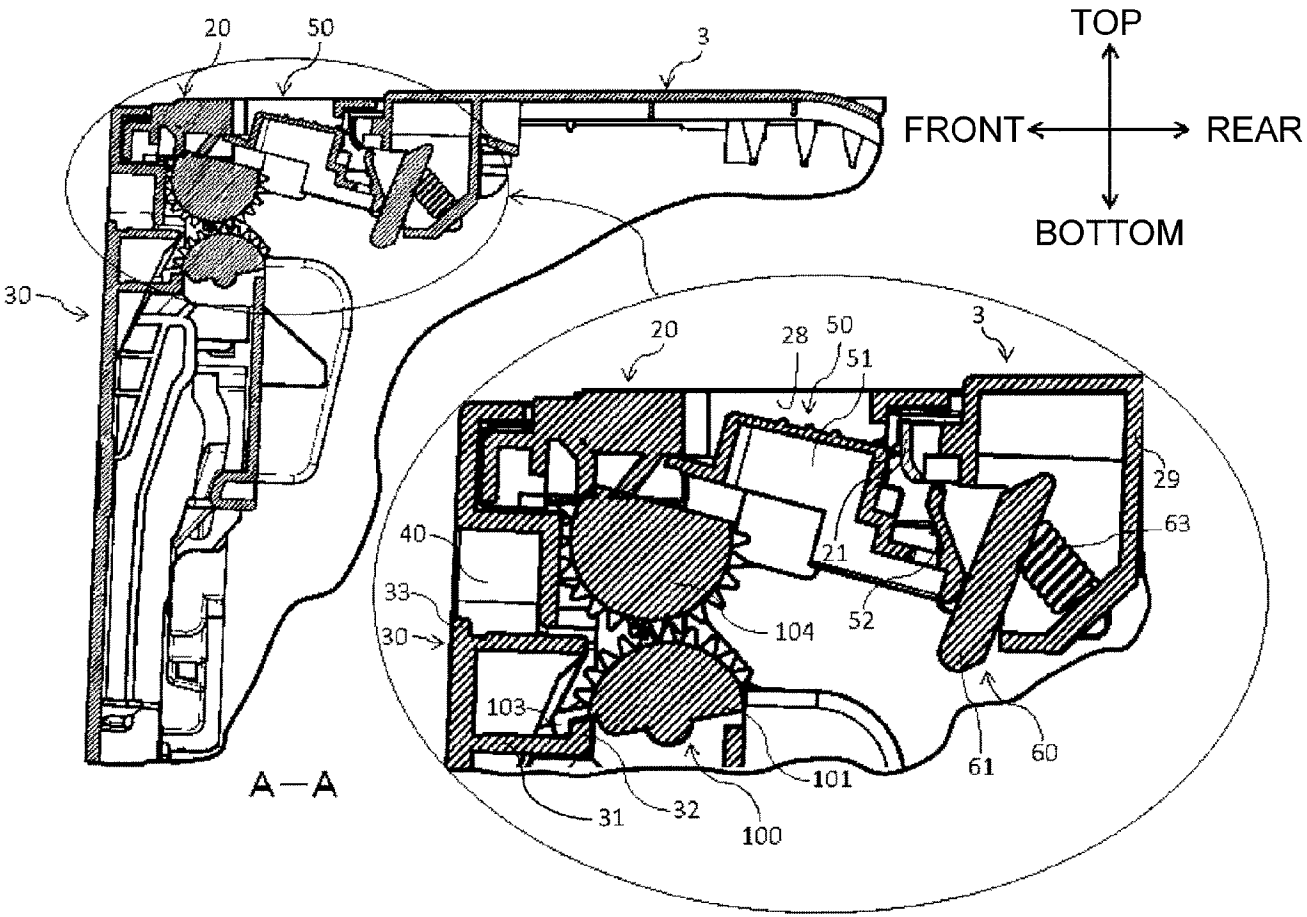
FIG. 8 a sectional view along the A-A line of FIG. 5 when the pressing portion is in a first release position.

As illustrated in FIGS. 6 and 8, when the front cover 20 is in the closed position, the first lock member 50 is movable between a first lock position in which the first engaging portions 52 engage with the engagement receiving portion 21 and a first release position in which the first engaging portions 52 pivot downward and are disengaged from the engagement receiving portion 21. When the first lock member 50 is in the first lock position, the front cover 20 is locked in the closed position relative to the casing 3. When the first lock member 50 is in the first release position, the locked state of the front cover 20 is released. The first lock member 50 moves from the first lock position to the first release position when the pressed portion 51 is pressed from above.

Figure 7:
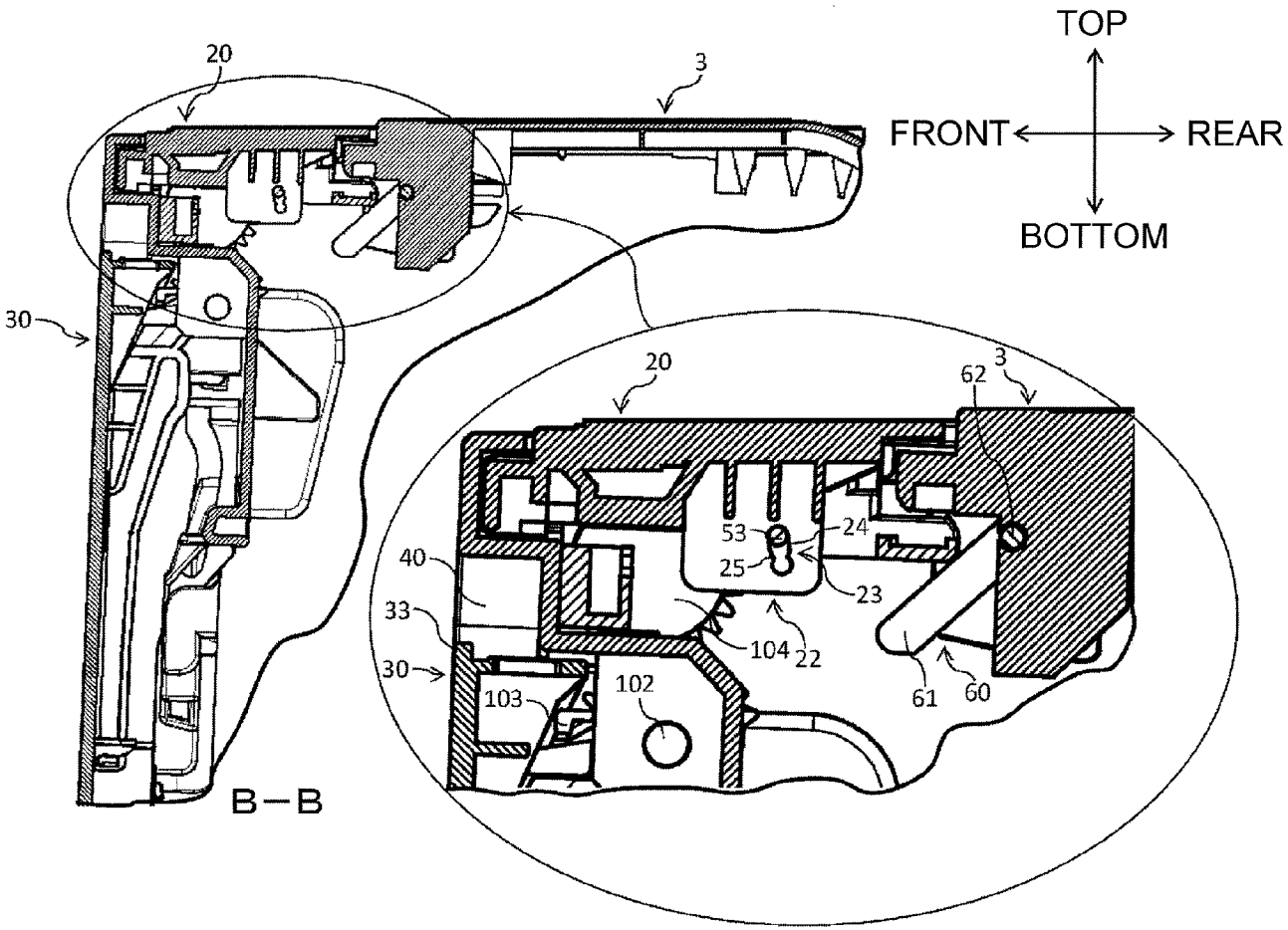
FIG. 7 is a sectional view along the B-B line of FIG. 5 when the pressing portion is in the first lock position.

As illustrated in FIG. 7, the first lock member 50 includes a protruding portion 53 as an example of a movable portion. There are two protruding portions 53 each protruding outward or to the left or right from the first lock member 50 in the left-right direction. FIG. 7 s a sectional view of essential parts of the image forming apparatus 1 taken along the B-B line of FIG. 5. A planar cross section taken along the B-B line of FIG. 5 includes a position of a right end portion of the right protruding portion 53.

Each protruding portion 53 moves substantially vertically in response to moving of the first lock member 50 between the first lock position and the first release position. The front cover 20 includes bearings 22 each extending downward from the front cover 20 and supporting a corresponding protruding portion 53 movably.

Each bearing 22 is substantially rectangular shaped and has, in a lower end portion thereof, a guide groove 23 as an example of a retention portion. The guide groove 23 has a guide portion 24 and a restriction portion 25 disposed in a lower portion of the guide portion 24. The guide portion 24 is configured to guide the protruding portion 53 substantially vertically during movement of the first lock member 50 between the first lock position and the first release position. The restriction portion 25 is configured to restrict movement of the protruding portion 53 at the lower portion of the guide portion 24.

The guide portion 24 is shaped like a long hole extending substantially vertically, and functions as a groove for guiding the protruding portion 53 substantially vertically during the movement of the first lock member 50 from the first lock position to the first release position.

The protruding portion 53 is located at an upper end of the guide portion 24 when the first lock member 50 is in the first lock position, and is located at a lower end of the guide portion 24 when the first lock member 50 is in the first release position.

The restriction portion 25 protrudes inwardly from opposite edge portions defining the guide portion 24 substantially in the front-rear direction. The restriction portion 25 is provided proximate to the lower end of the guide portion 24 and configured to restrict upward movement of the protruding portion 53 in contact therewith when the protruding portion 53 is located at the lower end of the guide portion 24.

As illustrated in FIG. 6, a protruding wall 29 protruding substantially downward from the casing 3 is disposed at the rear of the engagement receiving portion 21. The protruding wall 29 is provided with a releasing portion 60 that is configured to contact the first lock member 50 located in the first release position and to move the first lock member 50 to the first lock position. The releasing portion 60 includes a deformable plate 61, a pivot shaft 62, and a springy member 63.

The deformable plate 61 is formed of resin, has substantially a rectangle shape extending in the left-right direction, and is configured to be deformable. As illustrated in FIG. 7, the deformable plate 61 has the pivot shaft 62 extending in the left-right direction at each end portion of the deformable plate 61. The deformable plate 61 is pivotable as the pivot shaft 62 is supported by the casing 3. The deformable plate 61 is pivotable between a non-pressure position in which the first lock member 50 is in the first lock position and the deformable plate 61 does not receive pressure from the first lock member 50 and a pressure position in which the deformable plate 61 receives the pressure from the first lock member 50 and moves downward from the non-pressure position. The deformable plate 61 is urged diagonally upward by the springy member 63.

When the front cover 20 is in the closed position and the first lock member 50 is in the first lock position, the protruding portion 53 of the first lock member 50 is located at the upper end of the guide portion 24 and the deformable plate 61 is located in the non-pressure position.

With the front cover 20 in the closed position, when the pressed portion 51 is pressed from above, the first lock member 50 located in the first lock position moves toward the first release position.

At this time, the protruding portion 53 located at the upper end of the guide portion 24 moves downward along the guide portion 24 in response to moving of the first lock member 150 toward the first release position.

Figure 9:
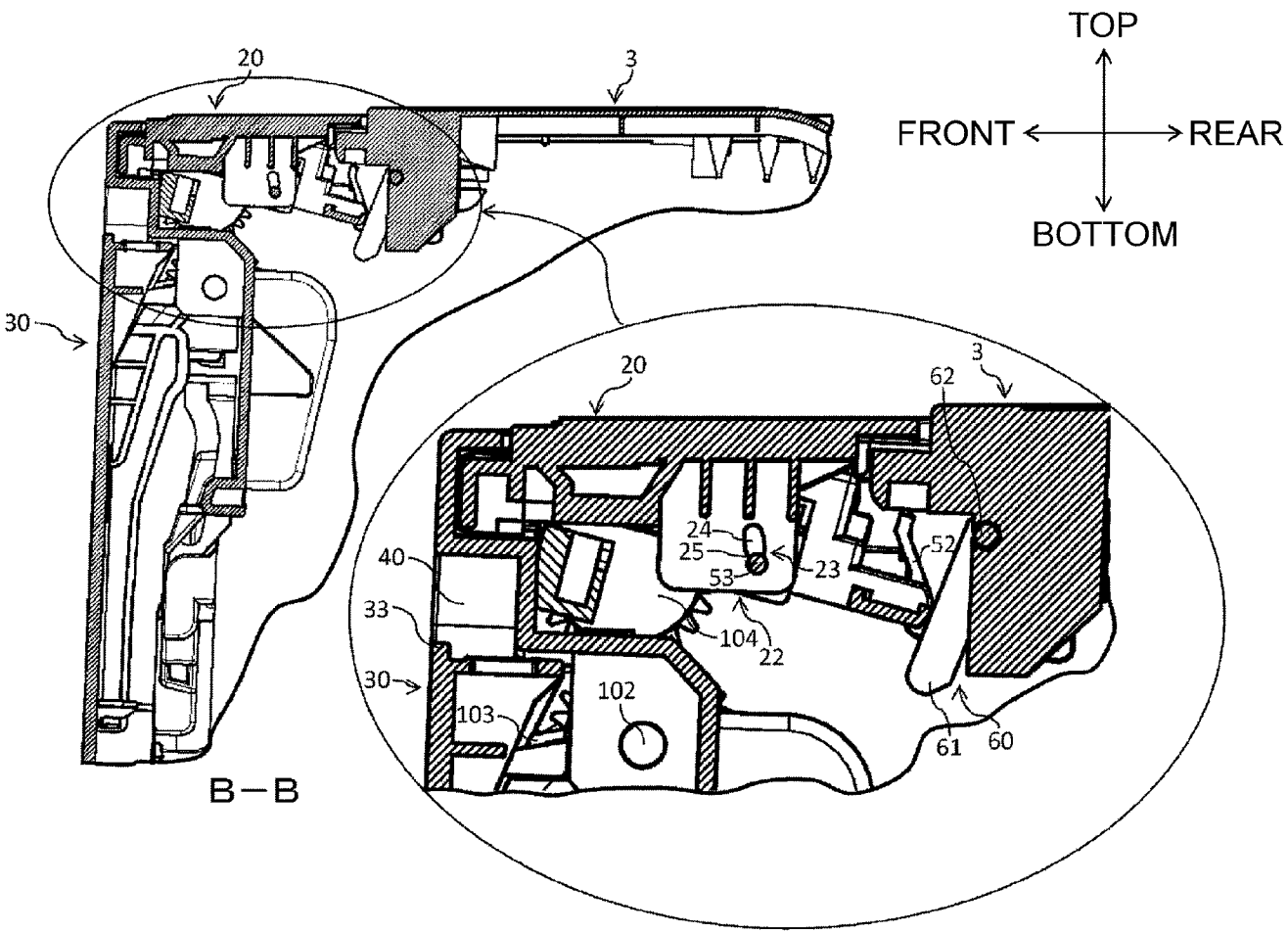
FIG. 9 is a sectional view along the B-B line of FIG. 5 when the pressing portion is in the first release position
Figure 10:
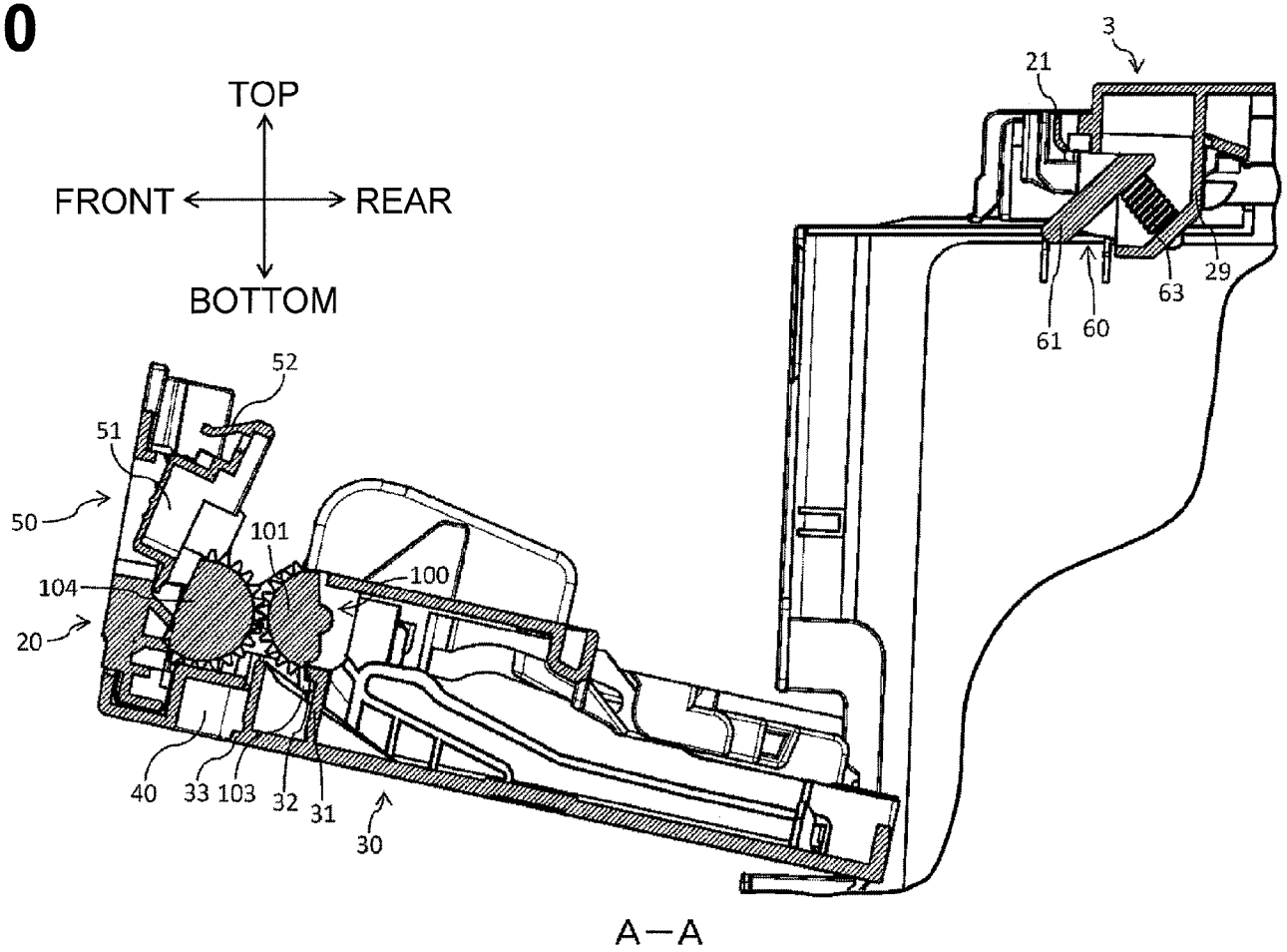
FIG. 10 is a sectional view along the A-A line of FIG. 5 when the front cover is in the open position.

When the first lock member 50 moves to the first release position, the protruding portion 53 moves to the lower end of the guide portion 24 as illustrated in FIG. 9. At this time, the protruding portion 53 is restricted from moving upward by the restriction portion 25. This keeps the first lock member 50 in the first release position after the pressed portion 51 has been released from being pressed.

The following will describe the structure of the MP tray 30 in detail. The MP tray 30 is substantially rectangular shaped, and is supported by the front cover 20 such that it pivots between a first position covering the opening 27 of the front cover 20 and a second position uncovering the opening 27 of the front cover 20. As illustrated in FIG. 4, when the MP tray 30 pivots to the second position, it extends diagonally upward from the front cover 20 located in the closed position.

The MP tray 30 includes left and right tray engaging portions 150 extending, perpendicularly to the MP tray 30, from left and right end portions thereof, respectively. The tray engaging portions 150 are made of resin and deformable substantially in the left-right direction such that the tray engaging portions 150 engage the respective tray engaged portions 160.

When the MP tray 30 is closed to the first position, the tray engaging portions 150 become deformed substantially in the left-right direction, and engage the respective tray engaged portion such that the MP tray 30 is kept in the first position.

As illustrated in FIG. 6, the MP tray 30 includes a contact portion 31 extending rearward from a rear portion of the MP tray 30 and a hook receiving portion 32 extending upward from the contact portion 31. The contact portion 31 is configured to contact a hook member 103 from below. The hook receiving portion 32 is configured to engage the hook member 103. The upper end portion of the MP tray 30 contains a handle portion 33 at which the user places his or her fingertips to open the MP tray 30. The handle portion 33 extends upward from the upper end of the MP tray 30 and is formed integrally with the contact portion 31 and the hook receiving portion 32.

A structure of a MP tray lock mechanism to lock the MP tray 30 in the first position will be described in detail. The MP tray lock mechanism includes a second gear 104 as an example of a responsive member, and a second lock member 100.

The second gear 104 is integrally formed of resin with a front end portion of the first lock member 50. The second gear 104 is configured to rotate about the pivot of the first lock member 50 along with the first lock member 50.

The second lock member 100 is disposed below the second gear 104. The second lock member 100 includes a first gear 101 as an example of a rotating member and a hook member 103 as an example of an engaging member.

The first gear 101 is disposed below the second gear 104 and in engagement therewith. The first gear 101 has a gear shaft 102 extending from each of left and right end portions of the first gear 101 in the left-right direction. The first gear 101 is configured to rotate about the gear shaft 102 supported by the front cover 20. A front end portion of the first gear 101 includes the hook member 103 extending frontward from the first gear 101.

With the MP tray 30 located in the first position, the first gear 101 is configured to rotate between a second lock position illustrated in FIG. 8 in which the hook member 103 is in engaged with the hook receiving portion 32 and the MP tray 30 is locked in the first position and a second release position illustrated in FIG. 8 in which the hook member 103 is disengaged from the hook receiving portion 32 and the lock of the MP tray 30 is released.

The second lock member 100 is configured to move to the second lock position in response to movement of the first lock member 50 to the first release position, and to move to the second release position in response to movement of the first lock member 50 to the first lock member.

The following will describe the operation of the MP tray lock mechanism in the case of opening the front cover 20.

As illustrated in FIG. 8, when the pressed portion 51 located in the first lock position is pressed from above with the front cover 20 located in the closed position, the first lock member 50 moves toward the first release position while pressing the deformable plate 61 located in the non-pressure position downward. At this time, the second gear 104 rotates clockwise when viewed from the right in response to the movement of the first lock member 50 from the first lock position to the first release position.

The first gear 101 located in the second release position rotates counterclockwise in response to the rotation of the second gear 104. In short, the first gear 101 rotates to the second lock position in response to the movement of the first lock member 50 to the first release position.

When the first gear 101 rotates to the second lock position, the hook member 103 contacts the contact portion 31 and engages the hook receiving portion 32, and the MP tray 30 is locked in the first position. In short, in response to the movement of the first lock member from the first lock position to the first release position, the hook member 103 engages the hook receiving portion 32 and the MP tray 30 is locked in the first position.

When the first lock member 50 moves from the first lock position to the first release position, the protruding portion 53 located at the upper end of the guide portion 24 moves to the lower end of the guide portion 24.

As the protruding portion 53 located at the lower end of the guide portion 24 is restricted from moving upward by the restriction portion 25, the first lock member 50 is kept in the first release position. As the first lock member 50 is kept in the first release position by the restriction portion 25, the engagement of the hook member 103 with the hook receiving potion 32 can be maintained even after the pressed portion 51 is released from being pressed. In short, even after the pressed portion 51 is released from being pressed, the second lock member 100 is kept in the second lock position and the MP tray 30 can be kept in the first position.

When the first lock member 50 moves from the first lock position to the first release position and the front cover 20 pivots from the closed position toward the open position, the front cover 20 pivots with the first lock member 50 being kept in the first release position by the restriction member 25, in other words, with the second lock member 100 being kept in the second lock position.

When the front cover 20 pivots to a predetermined position toward the open position, the deformable plate 61 is released from pressure from the first lock member 50 and is returned from the pressure position to the non-pressure position by the springy member 63.

When the front cover 20 further pivots toward the open position 20, the front cover 20 is located in the open position with the MP tray 30 being locked in the first position. The front cover 20 can be opened with MP tray 30 being locked in the first position in this manner. As the MP tray 30 is prevented from being opened during opening of the front cover 20, the usability can be improved.

As the first lock member 50 is kept in the first release position even after the pressed portion 51 is released from being pressed, the MP tray 30 can be kept in the first position without the need to continue pressing the pressed portion 51 while the front cover 20 is opened. Thus, there is no need to open the front cover 20 with the pressed portion 51 being pressed. The operation to open the front cover 20 can be simplified and the usability can be improved.

Further, the front cover 20 can be opened with the MP tray 30 being locked in the first position. Thus, force with which the tray engaging portions 150 engage the respective tray engaged portions 160 can be reduced to a minimum required to keep the MP tray 30 in the first position of when the front cover 20 is located in the closed position. Thus, the tray engaging portions 150 can engage the respective tray engaged portions 160 with small force and the MP tray 30 can be opened with small force, which can improve the usability.

The following will describe the operation of the MP tray lock mechanism in the case of closing the front cover 20.

The front cover 20 located in the open position pivots toward the closed position, while the engagement of the hook member 103 with the hook receiving portion 32 is maintained, that is, the locked state of the MP tray 30 in the first position is maintained.

When the front cover 20 pivots to a predetermined position toward the closed position, the first lock member 50 located in the first release position starts to contact the deformable plate 61 located in the non-pressure position.

When the front cover 20 further pivots toward the closed position, the deformable plate 61 located in the non-pressure position contacts the first lock member 50 located in the first release position, receives pressure from the first lock member 50, and moves to the pressure position. At this time, as the deformable plate 61 is urged upward by the springy member 63, the first lock member 50 located in the first release position receives an upward elastic force from the springy member 63.

An upward elastic force the protruding portion 53 receives from the deformable plate 61 is set greater than a force required for the protruding portion 53 to move over the restriction portion 25. Thus, when the front cover 20 pivots to the closed position, the protruding portion 53 moves upward over the restriction portion 25 and reaches the upper end of the guide portion 24. In short, the deformable plate 61 releases the restriction of movement of the protruding portion 53 when the front cover 20 pivots from the open position to the closed position.

When the protruding portion 53 reaches the upper end of the guide portion 24, the first lock member 50 located in the first release position is disposed in the first lock position and the front cover 20 is locked in the closed position.

While the first lock member 50 is moved to the first lock position by the deformable plate 61, the second gear 104 rotates counterclockwise. While the second gear 104 rotates counterclockwise, the first gear 101 located in the second lock position rotates clockwise toward the second release position. While the first gear 101 rotates to the second release position, the engagement of the hook member 103 with the hook receiving portion 32 is released.

In short, the second lock member 100 located in the second lock position moves to the second release position in response to the movement of the first lock member 50 to the first lock position. The locked state of the MP tray 30 in the first position is released in this manner.

The first embodiment shows, but is not limited to, the MP tray lock mechanism including the second gear 104, which is integrally formed with the front end portion of the first lock member 50, and the first gear 101 disposed below the second gear 104.

A second embodiment of the disclosure will be described with reference to FIGS. 11 and 12. A MP tray lock mechanism of the second embodiment is identical, in structure except for the first gear 101 and the second gear 104, to the MP tray lock mechanism of the first embodiment.

It is noted that, in the following description, elements similar to or identical with those illustrated and described in the first embodiment are designated by similar numerals, and thus the description thereof can be omitted for the sake of brevity.

Figure 11:
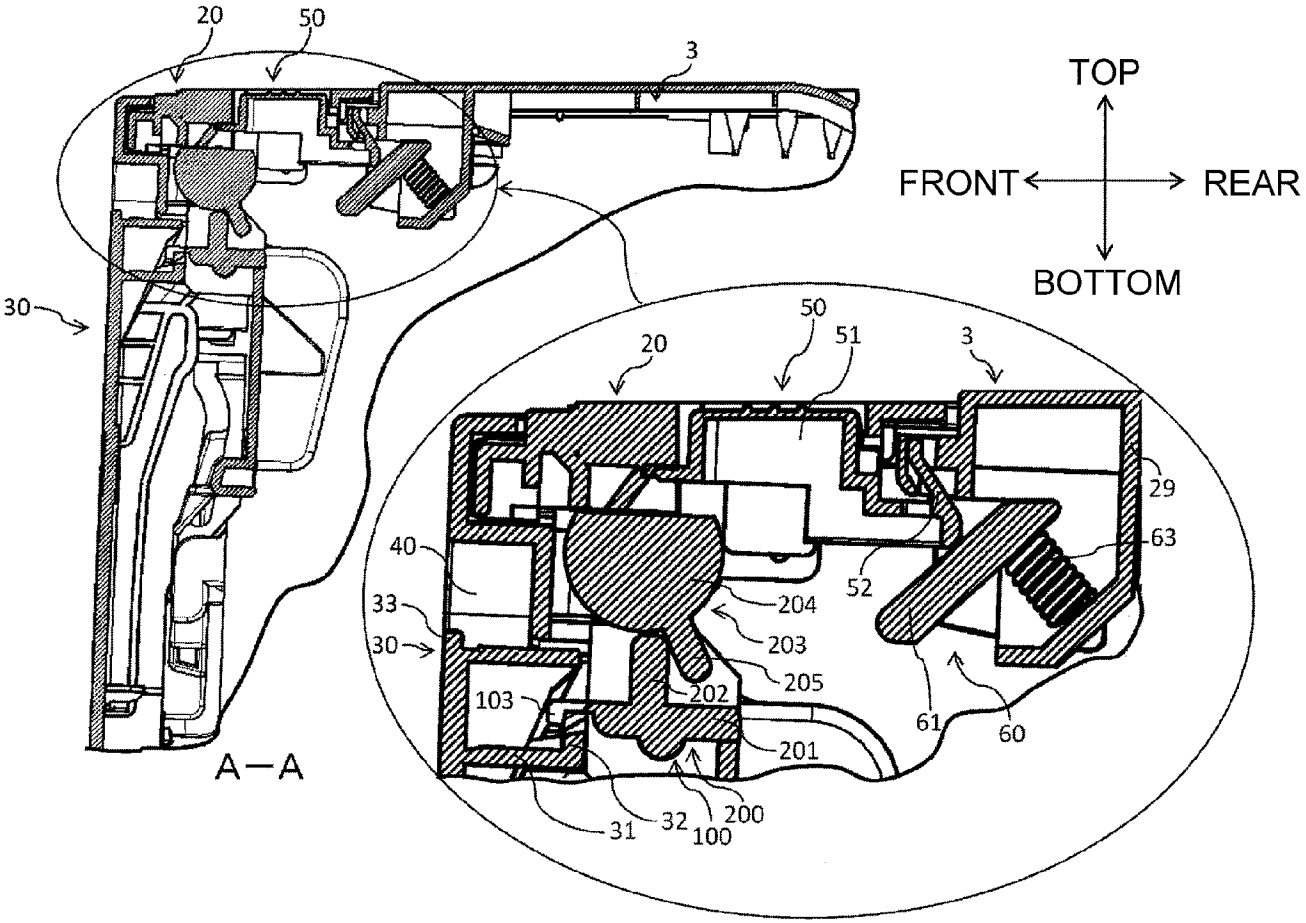
FIG. 11 is a sectional view, along the A-A line of FIG. 5, illustrating a responsive member and a rotating member according to a second embodiment.
Figure 12:
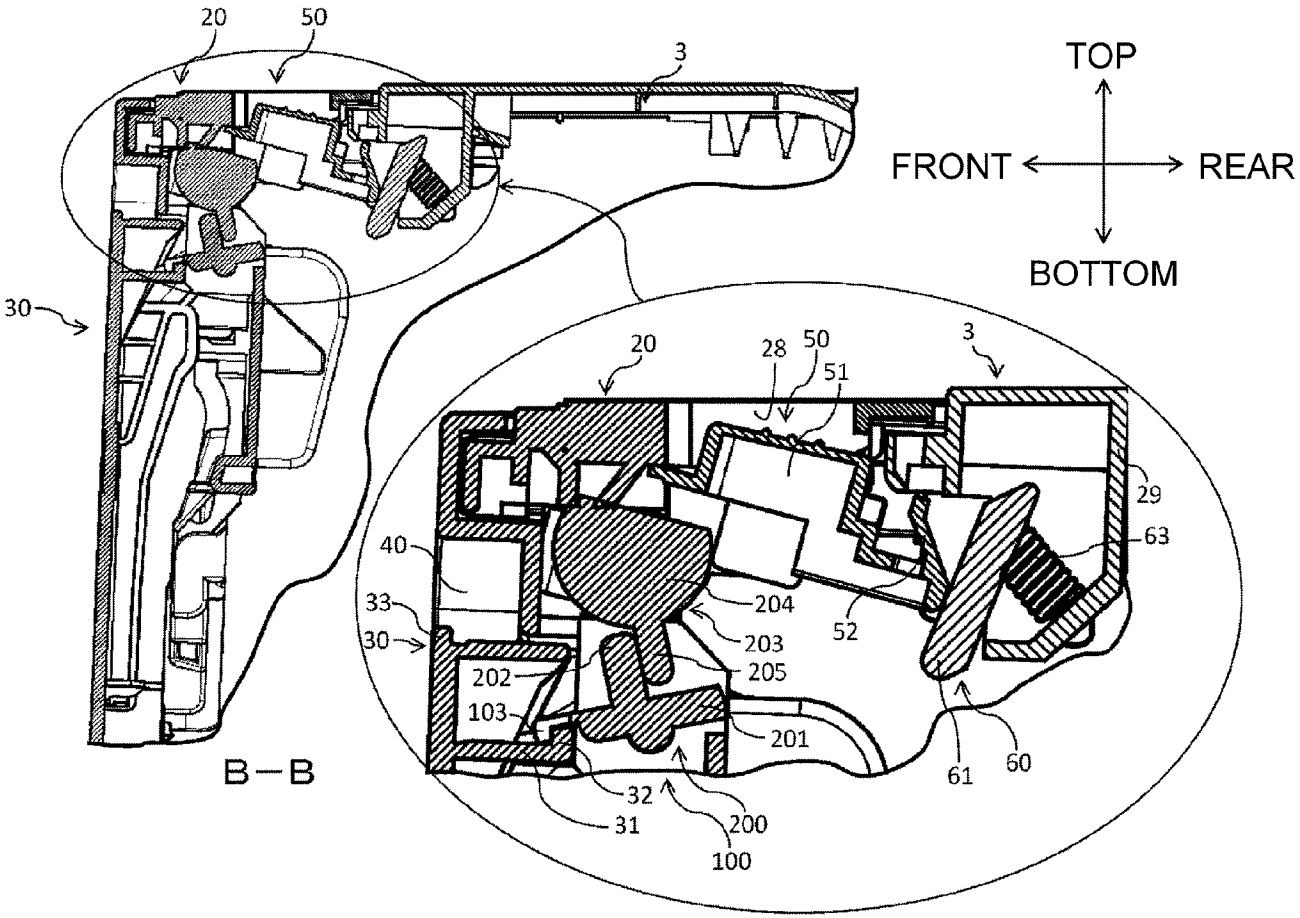
FIG. 12 is a sectional view, along the B-B line of FIG. 5, illustrating the responsive member and the rotating member according to the second embodiment.

As illustrated in FIG. 11, the MP tray lock mechanism includes a second lever 203, as an example of a responsive member, which is integrally formed with the front end portion of the first lock member 50 and extends downward. The second lever 203 includes a semicircular member 204 and a second protruding portion 205.

The semicircular member 204 is substantially semicircular shaped and integrally formed of resin with the first lock member 50. The second protruding portion 205 protrudes substantially downward from the semicircular member 204.

The second lock member 100 is disposed below the second lever 203. The second lock member 100 includes a first lever 200 as an example of a rotating member and the hook member 103 as an example of an engaging member. The first lever 200 is disposed below the second lever 203 and includes a base portion 201 and a first protruding portion 202.

The base portion 201 is substantially rectangular shaped when viewed from the top and has lever shafts (not illustrated) extending in the left-right direction from left and right end portions of the base portion 201, respectively. The lever shafts are supported by the front cover 20. The first lever 200 is configured to pivot about the lever shafts. The lever shafts may be supported by the MP tray 30.

The first protruding portion 202 protrudes substantially upward from the base portion 201 and contacts the second protruding portion 205 of the second lever 203. A front end portion of the base portion 201 includes the hook member 103 extending frontward from the base portion 201.

With the MP tray 30 located in the first position, the first lever 200 is configured to pivot between a second lock position in which the hook member 103 engages the hook receiving portion 32 in response to the movement of the first lock member 50 to the first release position and a second release position in which the hook member 103 is disengaged from the hook receiving portion 32 in response to the movement of the first lock member 50 to the first lock position. The first lever 200 is urged by an elastic member (not illustrated) and kept in the second release position.

The following will describe the operation of the MP tray lock mechanism in the second embodiment based in the case of opening the front cover 20. With the front cover 20 located in the closed position, when the pressed portion 51 is pressed from above, the first lock member 50 located in the first lock position moves to the first release position.

The second lever 203 moves and the second protruding portion 205 presses the first protruding portion 202 to the front in response to the movement of the first lock member 50 from the first lock position to the first release position.

The first protruding portion 202 receives a pressure from the second protruding portion 205 and moves frontward in response to the movement of the second protruding portion 205, and the first lever 200 located in the second release position moves to the second lock position. In other words, as illustrated in FIG. 12, the second lever 203 moves the first lever 200 to the second lock position in response to the movement of the first lock member 50 from the first lock position to the first release position.

The hook member 103 engages the hook receiving portion 32 in response to the movement of the first lever 200 to the second lock position, and the MP tray 30 is locked in the first position.

The following will describe the operation of the MP tray lock mechanism in the second embodiment in the case of closing the front cover 20. The first lock member 50 located in the first release position moves to the first lock position in response to the movement of the front cover 20 located in the open position toward the closed position.

The second lever 203 moves in response to the movement of the first lock member 50 to the first lock position, and the second protruding portion 205 moves rearward. As the first lever 200 is urged by an urging member, not illustrated, such that it is kept in the second release position, the first lever 200 moves from the second lock position to the second release position in response to the rearward movement of the second protruding portion 205.

In this manner, the hook member 103 is disengaged from the hook receiving portion 32 in response to the movement of the front cover to the closed position, and the locked state of the MP tray 30 in the first position is released.

The first and second embodiments show, but are not limited to, that the first lock member 50 has a pivot (not illustrated) supported by the front cover 20 and the front cover 20 includes bearings 22 each extending downward from the front cover 20 and supporting a corresponding protruding portion 53 movably. The pivot of the first lock member 50 may be supported by the casing 3, and the protruding portion 53 may be supported by the casing 3.

The first and second embodiments show, but are not limited to, that the MP tray 30 is supported by the front cover 20. The MP tray 30 may be supported by the casing 3.

The first and second embodiments show, but are not limited to, that the first gear 101 and the first lever 200 are supported by the front cover 20 and the hook member 103 engages the hook receiving portion 32. The first gear 101 and the first lever 200 may be supported by the MP tray 30 and the hook member 103 may engage the hook receiving portion 32 formed in the front cover 20.

The first and second embodiments show, but are not limited to, the second gear 104 and the second lever 203 as an example of a responsive member. The responsive member may include a link member, e.g., an arm.

The first and second embodiments show, but are not limited to, the front cover 20 including a retention portion. The retention portion may be included in the second lock member 100 or the responsive member.

The first and second embodiments show, but are not limited to, the first lock member 50 and the second lock member 100 configured to pivotally move. The first lock member 50 and the second lock member 100 may be configured to slide vertically or sideways by being pressed.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an image forming unit configured to form an image on a sheet;

a casing accommodating the image forming unit therein;

a cover member having an opening and supported by the casing such that the cover member pivots between a closed position in which the cover member is closed relative to the casing and an open position in which the cover member is opened relative to the casing;

a first lock member configured to move between a first lock position in which the cover member is locked in the closed position and a first release position in which a locked state of the cover member is released;

a tray configured to pivot between a first position covering the opening of the cover member and a second position uncovering the opening of the cover member; and a second lock member configured to move between a second lock position in which the tray is locked in the first position and a second release position in which a locked state of the tray is released, the second lock member being configured to move to the second lock position in response to movement of the first lock member to the first release position.

2. The image forming apparatus according to claim 1, wherein, when the cover member pivots from the closed position toward the open position, the second lock member is kept in the second lock position.

3. The image forming apparatus according to claim 1, further comprising a retention portion configured to, when the cover member pivots from the closed position toward the open position, keep the second lock member in the second lock position.

4. The image forming apparatus according to claim 3, wherein the retention portion is configured to keep the first lock member in the first release position.

5. The image forming apparatus according to claim 4, wherein the first lock member includes a movable portion supported by the cover member and configured to move in response to movement of the first lock member, wherein the retention portion includes a guide groove for guiding the movable portion when the first lock member moves between the first lock position and the first release position, and wherein the guide groove includes a restriction portion configured to, when the first lock member is located in the first release position, restrict movement of the movable portion.

6. The image forming apparatus according to claim 3, wherein the casing includes a releasing portion configured to release a locked state of the second lock member in the second lock position by the retention portion when the cover member pivots from the open position to the closed position.

7. The image forming apparatus according to claim 5, wherein the casing includes a releasing portion configured to release a locked state of the second lock member in the second lock position by the retention portion when the cover member pivots from the open position to the closed position, wherein the releasing portion is configured to be deformable, wherein the releasing portion is configured to contact the first lock member located in the first release position and is configured to, when the cover member pivots from the open position to the closed position, release a restricted state by the restriction portion and move the first lock member to the first lock position, and wherein the second lock member is configured to move the second release position in response to movement of the first lock member to the first lock position.

8. The image forming apparatus according to claim 1, wherein the second lock member is disposed in one of the cover member and the tray, the second lock member including a rotating member configured to rotate between the second lock position and the second release position and an engaging member configured to engage one of the cover member and the tray in response to rotation of the rotating member to the second lock position and to disengage from one of the cover member and the tray in response to rotation of the rotating member to the second release position, and wherein the rotating member rotates to the second lock position in response to movement of the first lock member to the first release position.

9. The image forming apparatus according to claim 8, wherein the rotating member includes a first gear included in the cover member, and wherein the engaging member includes a hook member included in the first gear.

10. The image forming apparatus according to claim 9, further comprising a responsive member to rotate the first gear to the second lock position in response to movement of the first lock member to the first release position.

11. The image forming apparatus according to claim 10, wherein the responsive member includes a second gear included in the first lock member and configured to mesh with the first gear.

12. The image forming apparatus according to claim 8, wherein the rotating member includes a first lever included in the cover member, and wherein the engaging member includes a hook member included in the first lever.

13. The image forming apparatus according to claim 12, further comprising a responsive member to rotate the first lever to the second lock position in response to movement of the first lock member to the first release position.

14. The image forming apparatus according to claim 13, wherein the responsive member includes a second lever included in the first lock member and configured to contact the first lever.

* * * * *